US007690165B2

(12) United States Patent
Taylor

(10) Patent No.: US 7,690,165 B2
(45) Date of Patent: Apr. 6, 2010

(54) INSULATING COVER

(76) Inventor: Joe H. Taylor, 961 Brooks Ave., Rosenberg, TX (US) 77471

( * ) Notice: Subject to any disclaimer, the term of this patent is extended or adjusted under 35 U.S.C. 154(b) by 966 days.

(21) Appl. No.: 11/242,096

(22) Filed: Sep. 28, 2005

(65) Prior Publication Data

US 2007/0095608 A1 May 3, 2007

(51) Int. Cl.

| | |
|---|---|
| ***E02D 29/14*** | (2006.01) |
| ***E04B 7/00*** | (2006.01) |
| ***E04F 11/00*** | (2006.01) |
| ***E04B 1/74*** | (2006.01) |

(52) U.S. Cl. ..... 52/406.1; 52/19; 52/23; 52/186; 182/78; 182/46; 182/81; 182/47

(58) Field of Classification Search ..... 182/78, 182/46, 81, 47; 52/19, 20, 23, 186, 406.1
See application file for complete search history.

(56) References Cited

U.S. PATENT DOCUMENTS

| | | | | |
|---|---|---|---|---|
| 2,321,499 | A * | 6/1943 | Marschke | 182/81 |
| 4,151,894 | A * | 5/1979 | Edwards | 182/77 |
| 4,281,743 | A * | 8/1981 | Fuller | 182/46 |
| 4,344,505 | A * | 8/1982 | Waters et al. | 182/47 |
| 4,372,196 | A * | 2/1983 | Henderson | 454/349 |
| 4,832,153 | A * | 5/1989 | Daw et al. | 182/46 |
| 5,274,966 | A * | 1/1994 | Daley | 52/23 |
| 5,628,151 | A * | 5/1997 | Monat | 52/19 |
| 5,867,946 | A * | 2/1999 | Seagren | 52/19 |
| 6,754,995 | B1 * | 6/2004 | Davis et al. | 52/95 |
| 2004/0055819 | A1 * | 3/2004 | Lynn et al. | 182/46 |

* cited by examiner

*Primary Examiner*—Richard E Chilcot, Jr.
*Assistant Examiner*—Mark R Wendell
(74) *Attorney, Agent, or Firm*—Timothy F. Mills

(57) ABSTRACT

An insulating cover for an attic or other opening is provided which mounts on top of a stair frame or framed opening or the like without the necessity of attic flooring, characterized by economical construction, economical shipping, ease of assembly, ease of installation above the opening, and a footprint substantially similar to the frame of the folding stair or the empty opening. The present invention further provides an insulating cover that is rugged enough for continued use yet light enough and supported in such as way as to have an ease of opening, staying open and closing as the consumer needs. In a further embodiment, the invention components may be substantially flat packed for ease of shipping and handling. In a further embodiment, the invention provides a multifunction insulating cover that may be fitted with a ventilation means, such as a louver or powered fan to enable ventilation through the framed opening even though the attic cover would be closed. This embodiment provides a multipurpose function to the cover, thus eliminating the need for a separate roof or ceiling installed ventilation fan. In a still further embodiment, the present invention may be provided with a protective outer layer to better resist impact or weather.

27 Claims, 14 Drawing Sheets

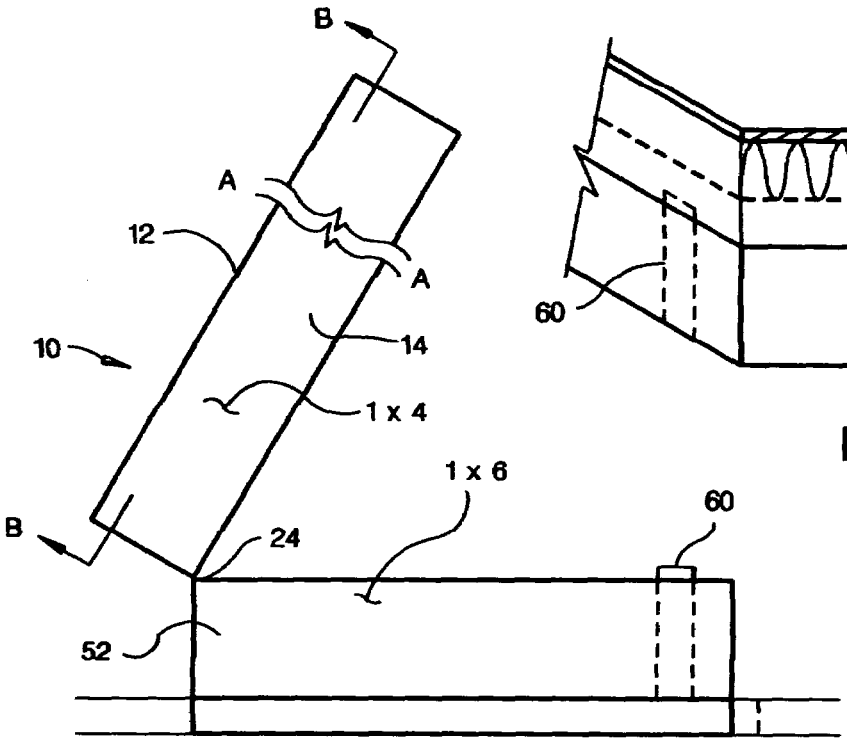
FIG. 1A
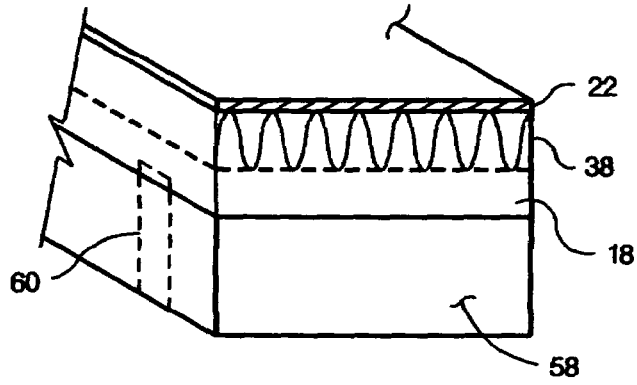
FIG. 1B
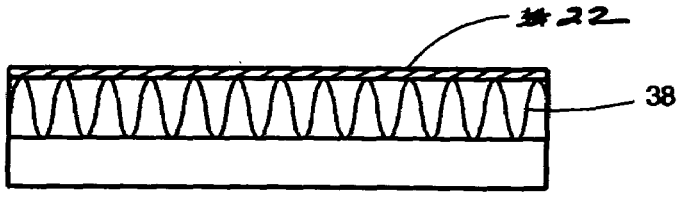
FIG. 1C
FIG. 1

INSULATING COVER

BACKGROUND OF THE INVENTION

The present invention relates generally to the field of devices used as thermal barriers to cover an opening in a ceiling such as a scuttle or access hole, and a process for insulating such opening. More particularly to the field of devices used to insulate a ceiling opening enclosing the drop-down style folding attic ladder. More particularly to a device for reducing or preventing temperature gain or loss through the attic opening when the stair is in the extended position, as well as when the stair is retracted into the stored position.

Attics or unheated spaces above ceilings are generally entered through an access hole cut and framed in a ceiling. These openings generally require the use of a step or extension ladder to be brought into the living space and placed at the opening for access. This inconvenience prompted the adaptation of a foldable ladder that disappeared into the ceiling, but could be pulled down for access into the attic. Thus, retractable, foldable or collapsible stair assemblies have been in use for many years to provide access to an overhead space.

The retracted stair assembly is typically enclosed in a wood frame installed between ceiling joists in a hallway to provide access to the overhead attic space, as illustrated in U.S. Pat. No. 2,572,281 (1949) to Pierce. When closed up into the ceiling, the opening is covered from below by a plywood or hardboard panel attached to a stair section. The plywood panel is mostly decorative, but may have an insulated strip around its perimeter to reduce hot or cold air transfer.

The advantage of this type of access system is that a separate permanent stairway to an attic is not necessary. However, a permanent stairway typically has a door that can be easily opened and closed with each trip up and down the attic stairs, thus preventing a large temperature gain or loss. Folding stairs, on the other hand, typically remain in the open or extended position, as shown in FIG. 1 of '281, during an entire project such as moving boxes into or out of the attic. Since attic spaces with restricted access are typically neither heated nor cooled, they can contain a large volume of very hot or very cold air. Thus when the stairs are in the open position, the heat or cold from the attic space invades the living area causing discomfort to the occupants and increased heating or cooling costs to return the living space to comfortable temperature. It is simply too inconvenient for most individuals to open and close the stair unit for every trip to and from the attic space.

Various articles have been devised to remediate temperature gain or loss through the opening when the stairs are closed. Even though the cover may have a perimeter gasket or be comprised of an insulating material, the panel is generally not thick enough, or well fitting enough, to significantly reduce or eliminate the temperature transfer problem. U.S. Pat. No. 4,567,074 (1986) to Litaker provided an insulated cover that fit over a trap door panel thereby reducing the temperature transfer through the trap door when it was in the closed position. A possible improvement is disclosed by Hunter in U.S. Pat. App. 2004/0172893 wherein a prefabricated sheet metal panel provided an exterior protective surface covering a Styrofoam slab in contact with the bottom plywood cover of the stair unit that is exposed at the ceiling. The unit was slid over the plywood cover and securely fastened. The unit seals the opening using perimeter weather stripping or gasketing. However, these units attach to the stair unit cover and project downward from the ceiling, unless extra work and expense is done to recess the stair unit up into the ceiling to make the additional add-on cover flush with the ceiling plane. A similar objection is raised to the ceiling covers illustrated in U.S. Pat. No. 6,014,841 (2000) to McCoy et al. and U.S. Pat. No. 6,601,352 (2003) to Obermeyer et al. In addition, when the stair unit is opened these covers are disengaged and provide no insulative barrier. If the person has several articles to store or retrieve, the stair must remain open for an extended period of time and a flood of hot or cold air from the attic space invades the living area. The only practical way to reduce the large volume air exchange is to install a cover above the folded stair in the attic space. But a simple batting of insulation pulled over the opening before the stair is folded is inadequate to many persons who demand a more reliable, accessible and effective barrier.

Thus, there exists a need for an attic mounted access cover to (1) install above an opening, scuttle hole or folded stair unit, (2) in an attic space without the need for a finished floor surrounding the opening, (3) that is inexpensive to purchase, (4) requires a minimum of expense and time to install, (5) is easy to open and close in a repetitive and reliable manner, (6) provides a means of positive repeatable alignment when closed, (7) is constructed of sturdy substantially rigid material not easily damaged, (8) that would take up no more attic floor space, open or closed, than the footprint of the framing for the opening, (9) that provides superior insulating capability from the heat and cold of the attic space, and (10) may be modified after purchase to conform to various opening dimensions as needed. Numerous attic mounted devices have been developed to address one or more of these requirements.

U.S. Pat. No. 4,151,894 (1979) to Edwards discloses an insulating box-shaped cover made of wood, fiberglass or plastic, that is deep enough to receive the folded stair unit and could be rolled away from the opening as the operator ascends or descends the stair. The unit is not made of insulating materials, but may be double walled to accommodate insulation therein. However, the unit requires a finished floor surrounding the framed opening to permit the unit to roll back and forth, and there is no means provided to positively align the lower edge over the opening when closed, enabling free lateral movements, particularly when the stair unit slams shut against the attic framing. The '894 design would most certainly move and expose the opening to the attic air thereby defeating its purpose entirely.

Similarly, U.S. Pat. No. 4,658,555 (1987) to Steiner provided a double-walled, insulation-filled hatchway cover utilizing foam or fiberglass to act as a seal against a rough board face. This type of free-moving cover, like '894 above, requires the user to push the entire unit out of the way onto attic insulation or flooring. The claims state that the 'interlocking surface' is just a rough board and the 'interlocking seal' is merely fiberglass bat insulation on the edges to 'impede shifting' of the cap. Again, there is no means to allow repetitive alignment when open or closed to maintain optimum sealing. In addition, the fiberglass bat acting as a seal will wear down from contact with the rough board, and since it supports the weight of the cap, will compress down flush with the edge of the cover greatly reducing its ability to provide positive sealing from the attic air infiltration.

U.S. Pat. No. 4,281,743 (1981) to Fuller discloses a knock-down, segmented, box-shaped attic opening cover comprised of lightweight insulating materials, such as polystyrene foam, so that it could be readily and easily moved to cover or uncover the opening. While the light weight and segmented parts have certain advantages, the insulating material has no protective covering and thus could be easily damaged. Such foam with joints is also prone to fatigue in the elevated heat of an attic. Further, the design does not provide a positive sealing configuration on its bottom edge or at the segmented joints, it just rests in place like '894 above, and would therefore be easily shifted during closure of the attic stair unit. In addition, when such a free-standing cover is pushed aside and the person is working in the attic, there is nothing rigid to cover the exposed opening, presenting a possible safety issue for a person to fall through the opening, or a heavy object such as a box to cause the flimsy foam to collapse and drop through to the stair and floor below.

An improvement by Helbig in U.S. Pat. No. 4,312,423 (1982) discloses the insulated box-shaped opening cover preconfigured as a rigid foam packing box for shipment of the stair unit. With careful shipping and unpacking, the shipping box is then used as a lightweight cover for the stair opening. However, without a protective outer layer, damage to the foam during shipping would be expected considering the weight of the stair unit, along with the other disadvantages cited against '743 above.

Waters et al., in U.S. Pat. No. 4,344,505 (1982), utilized insulative material of sufficient thickness to form a substantially rigid frame and cover, and achieve an R value of at least 19 in the materials. Although the design is relatively light weight and provides an increased R value over '743 or '423 due to the thick rigid foam insulation, the foam insulation does not have a rigid protective covering leaving it susceptible to damage or collapse, as also stated against the preceding patents. In addition '505 does not disclose a means to positively attach the frame in place. Thus, we are led to believe that opening the cover will not cause the frame to shift. Without being secured, this light weight cover would certainly move around every time it was touched. The specification recites the option of a track mounting system, but it is not claimed.

U.S. Pat. No. 4,550,534 (1985) to Mariano et al. continues the use of rigid foam, but discloses it as a one piece molded dome-shaped cover that rests over the retracted stair and opens on a floor mounted hinge assembly. Again, the use of unprotected foam is prone to the damage as recited above. In addition, this unit requires a finished floor around the stair unit framing since the foam dome has a footprint larger than the framing. It also requires mounting a leaf spring behind the unit from the floor to the dome to aid in raising the cover, which most certainly would be an inconvenience projecting away from the cover. Further, it is quite large to ship as one piece for installation.

U.S. Pat. No. 4,591,022 (1986) to Sciambi et al. further discloses rigid foam employed in a foldable attic opening cover. As the person climbs the stair the cover is folded rearward of the opening behind the person and secured, causing the person to turn around while still on the stair to push and secure the folded members. While this arrangement does save some space, the act of turning around on the stair may present a safety issue for less-agile persons. In addition, this unit requires a finished floor around the stair unit framing since the foam frame has a footprint larger than the floor opening.

In U.S. Pat. No. 4,928,441 (1990), Daley improves upon the design of '534 by encapsulating the rigid foam tub within a plastic shell. However, this unit, like those above, required a finished floor around the stair unit framing since the foam dome has a footprint larger than the framing. It also required mounting exposed hinges lateral to the cover on the flooring to aid in raising and lowering the cover. These hinges, with a built in stop or rest for the open cover, could present a tripping hazard due to their exposed location. Further, like '534 it is quite large to ship as one piece for installation.

A further refinement of the use of insulating material to comprise the opening cover like '534 and '441 is illustrated in U.S. Pat. No. 5,274,966 (1994) to Daley wherein the segmented cover has a lateral hinge assembly molded therein. Daley addresses the shipping size issue by halving the unit. However, this assembly is still bulky to produce and ship, and easily damaged as unprotected foam. The cover also requires finished attic flooring like '534, '022 and '441 above because of its large footprint and hinge design. An alternative solution to the shipping issue was provided in U.S. Pat. No. 4,832,153 (1989) to Daw et al., wherein the cover was again made out of a plurality of lightweight insulting pieces, but configured such that the parts could be partially nested for shipping or storage. While shipping size and light weight are advantages, the design has the disadvantage of having a weak construction due to multiple segments, whether or not it is reinforced with fiberglass, and finished flooring since it is made to rest outside the stair unit framing. A further refinement by Dickinson in U.S. Pat. No. 5,475,955 (1995) provided an insulated telescoping assembly made out of lightweight material such as cardboard or plastic. The unit is shipped with the parts nested together, and then expanded to the appropriate length at installation. The design has the disadvantage of weak construction since it is hollow and made out of cardboard or thin plastic. In addition, it requires finished flooring around the stair unit since it has a much larger perimeter when expanded.

Lightweight construction was further enhanced by the disclosure of Freeman in U.S. Pat. No. 5,271,198 (1993) wherein cardboard was folded to compose a cover with hollow chambers that may be filled with insulation during installation. As in '955 above, the hollow cardboard shell has the disadvantage of weak construction and poor insulative ability, and this cover also requires finished flooring around the stair unit since it has a much larger perimeter. U.S. Pat. No. 5,623,795 (1997) to Padgett disclosed the use of a single thickness of cardboard to form an inexpensive cover resting on weather stripping. While cost effective, it shares the disadvantage of weak construction and poor insulative qualities with '198. U.S. Pat. No. 5,628,151 (1997) to Monat provided a similar lightweight cover except that pockets were provided in the structure in which insulation was placed at the time of installation. To seal off the attic air, it was designed to fit over the box framing of the stair like the cap of '490. But this design shares the disadvantage being oversized and of weak construction as noted in '795, '198 and others.

Seagren, in U.S. Pat. No. 5,867,946 (1999) showed that the singular use of insulating materials for attic opening covers, without an exterior protective layer, left the cover easily vulnerable to damage, required molds to fabricate, and large boxes to store and ship the units to installation. Whereas '946 disclosed individually fabricated side and top elements, comprised principally of a protective layer bonded to an inner insulating layer. These composite parts were fabricated flat without the need for molds, and shipped unassembled to minimize cost. However, the cover required finished attic flooring like '534, '022 and '441 above because of its large footprint and hinge design.

U.S. Pat. No. 4,337,602, (1982) to King, disclosed a flexible enclosure placed above a ceiling opening closed by a zipper or other fastener. While this arrangement, when closed would substantially prevent air movement, the thin material does not provide significant insulating value, the sidewalls could be easily damaged by a person carrying objects up and down the stairs, and the construction provides no safety capability. Continuing with the theme of a flexible removable cover, U.S. Pat. No. 4,675,225 (1987) to Cutler et al., disclosed a thermal blanket that stretched to cover the opening in the attic before the stair was closed. Exactly how you are to fit the blanket in place on the attic framing from below while standing on the stair is not disclosed. While this arrangement may prevent air movement, the thin material does not provide significant insulating value, and the construction provides no safety capability. A variation on the '602 concept of a flexible cover is disclosed by Williams in U.S. Pat. No. Re. 36,975 (2000) wherein an attic hatchway cover of tent-like structure utilizes a zipper to open and close the cover. Again, while the cover is flexible it does not contain significant insulating properties and is prone to damage due to its material, and the construction provides no safety capability.

In U.S. Pat. No. 6,223,490 (2001) to Wessley, a tall sleeve with an insulated removable cap was first installed in the framed ceiling opening. A collapsible stair unit was then installed within the sleeve. Thus air movement down from the attic is restricted by the presence of the cap and the sleeve walls extending vertically into the attic space. However, the sleeve walls may impede access to the attic. The tight fitting locking cap will require additional time and effort to remove and replace when laying on the attic floor or on unprotected insulation. This unit could not be used in an existing stair installation since the stair unit wood framing is fastened to the ceiling joists before the ceiling is finished.

To reduce the time and effort to move the cover, Vesperman in U.S. Pat. No. 4,541,208 (1985) disclosed use of parallel tracks to allow horizontal movement of a box-like pre-molded insulated cover, or enable the cover to raise from one side utilizing a hinge-like configuration in one track. However, the installation required existing finished flooring, and exact placement of the tracks to maximize sealing and prevent binding. In addition, like '505 above, there will be permanent tracks in place in the attic to move around or trip over during attic work and occupy a significantly larger area than just the framed opening. U.S. Pat. No. 5,220,757 (1993) to Hulligan did not use floor tracks, but rather a retractable flexible plastic plate or cover disposed in opposite parallel grooves of vertical side pieces, easy to open and close, thus providing a more convenient access to the attic space. However, the construction of the opening cover unit is quite large in comparison to the other inventions and it projects substantially into the attic space. It would restrict movement of large or cumbersome objects through the opening. In addition, the plastic plate provides no real insulating capability, and slides reward occupying additional attic space.

As noted above, the prior attempts at attic stair covers address only one or two specific issues important to the inventor, but ignore the other requirements beneficial to the consumer. The results from the references above are attic opening covers of 'extremes', from thin vinyl and cardboard covers, to large premolded domes of insulation, to an oversized expansive tambour-like apparatus. Thus, the consumer has to chose among the various devices based upon expense, or ease of installation, or size, or weight, without a choice encompassing all of these objectives.

SUMMARY OF THE INVENTION

With the foregoing in mind, it is an object of the present invention to provide a novel insulating cover for folding attic stairs, openings to spaces above ceilings, to the outdoors, or the like characterized by economical construction, economical shipping, ease of assembly, ease of installation above the opening, and a footprint substantially similar to the frame of the folding stair or the empty opening, thus finished flooring or a specially installed floor frame is not necessary.

It is a further object of the present invention to provide an insulating cover that is rugged enough for continued use, or the impact of the occasional object, yet light enough and supported in such as way as to have an ease of opening, staying open and closing as the consumer needs. The opening and closing may be through mechanical or electrical means.

It is a further object of the present invention to provide an insulating cover that may be optionally fitted with a ventilation means, such as a louver or powered fan to enable ventilation through the ceiling opening even though the attic cover could be in the closed position. This option would provide a multipurpose function to the cover, thus eliminating the need for a separate roof or ceiling installed ventilation fan.

It is a further object of the present invention to provide an insulating cover with superior insulation ability, yet fully functional as described above. The interior and exterior of the unit as provided to the consumer may have the amount of insulation installed as required by the consumer.

There are at least three sizes of stair units sold to consumers at the present time, but any custom size insulating cover could be made. A standard sized assembly could be provided with the respective pieces marked or scored to be cut for smaller unit installation.

An embodiment of the present invention would come to the consumer in its component pieces substantially flat packed for ease of shipping and handling. Assembly at the site would entail first securing the end and side pieces of the frame and attaching it in position with fasteners to the opening framing, or the stair frame or joists, assembling the cover, attaching the hinge apparatus to the frame and cover, and attaching any support apparatus, such as hydraulic or spring controlled mechanism to the inside of the frame and cover near the hinged end.

For those installations where the cover would benefit by a more substantial covering, an additional protective layer may be added made of sheet metal or other substantially rigid material. If weather exposure was a requirement, a flexible covering such as fiberglass or a synthetic membrane-like materials used in roofing, may be applied as a protective outer layer. Depending upon the installation and exposure, the entire exposed exterior of the insulating cover may be clad in the protective layer. Certainly, this outer protective layer could also cover a layer of insulation attached to the exterior of the insulating unit.

BRIEF DESCRIPTION OF THE DRAWINGS

FIG. 1A is a plan view of an embodiment of the present invention with the cover assembly in elevated position;

FIG. 1B is a sectional view of the embodiment of FIG. 1A at A-A, showing the internal configuration of the cover assembly and the lower frame;

FIG. 1C is a sectional view of the embodiment in FIG. 1A at B-B, showing the lateral aspect of the internal configuration of the cover assembly;

BRIEF DESCRIPTION OF THE INVENTION

Figure 3:
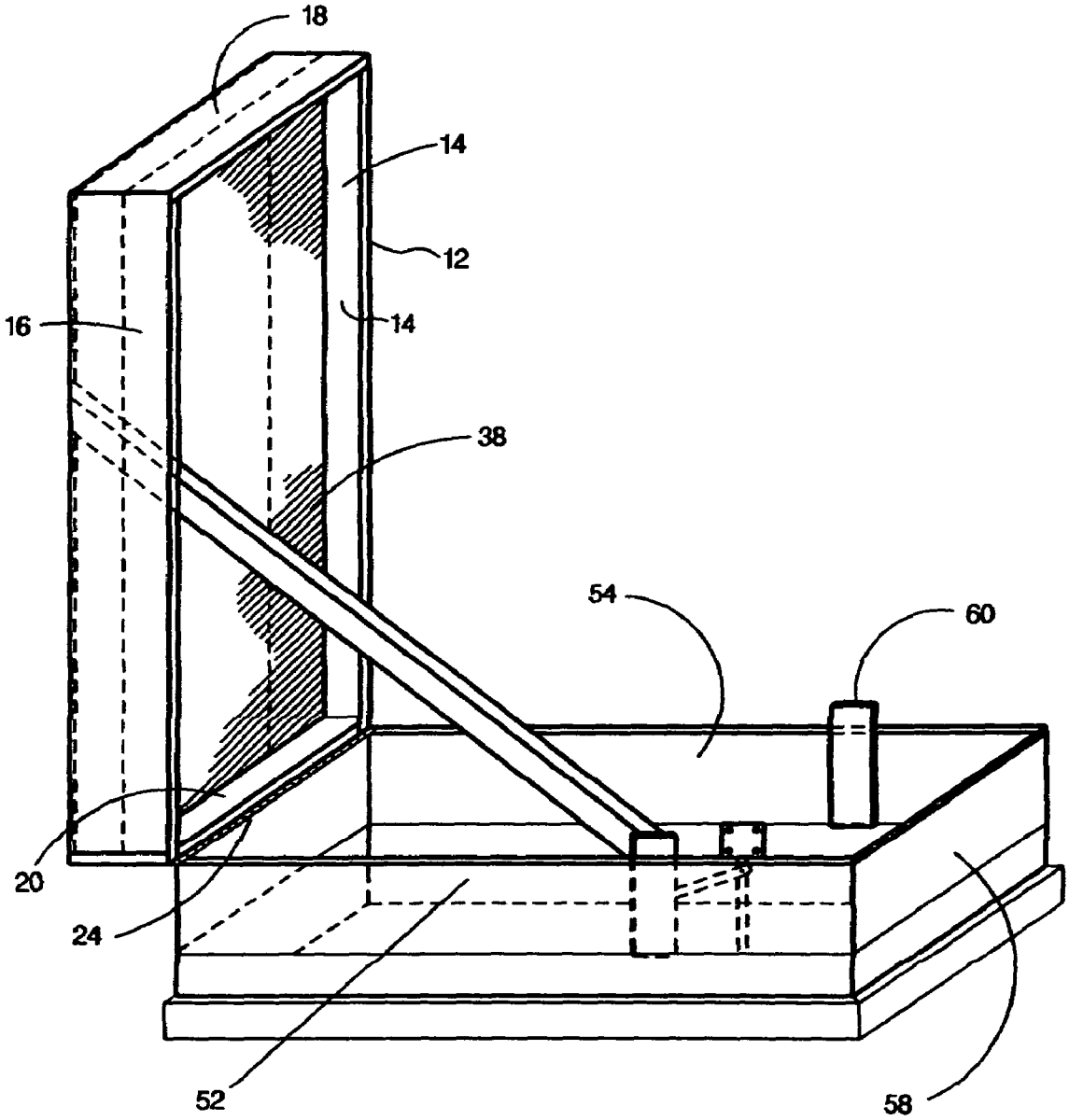
FIG. 3 is a view of an embodiment of the present invention installed in an attic with the folding stairs extended.
Figure 4:
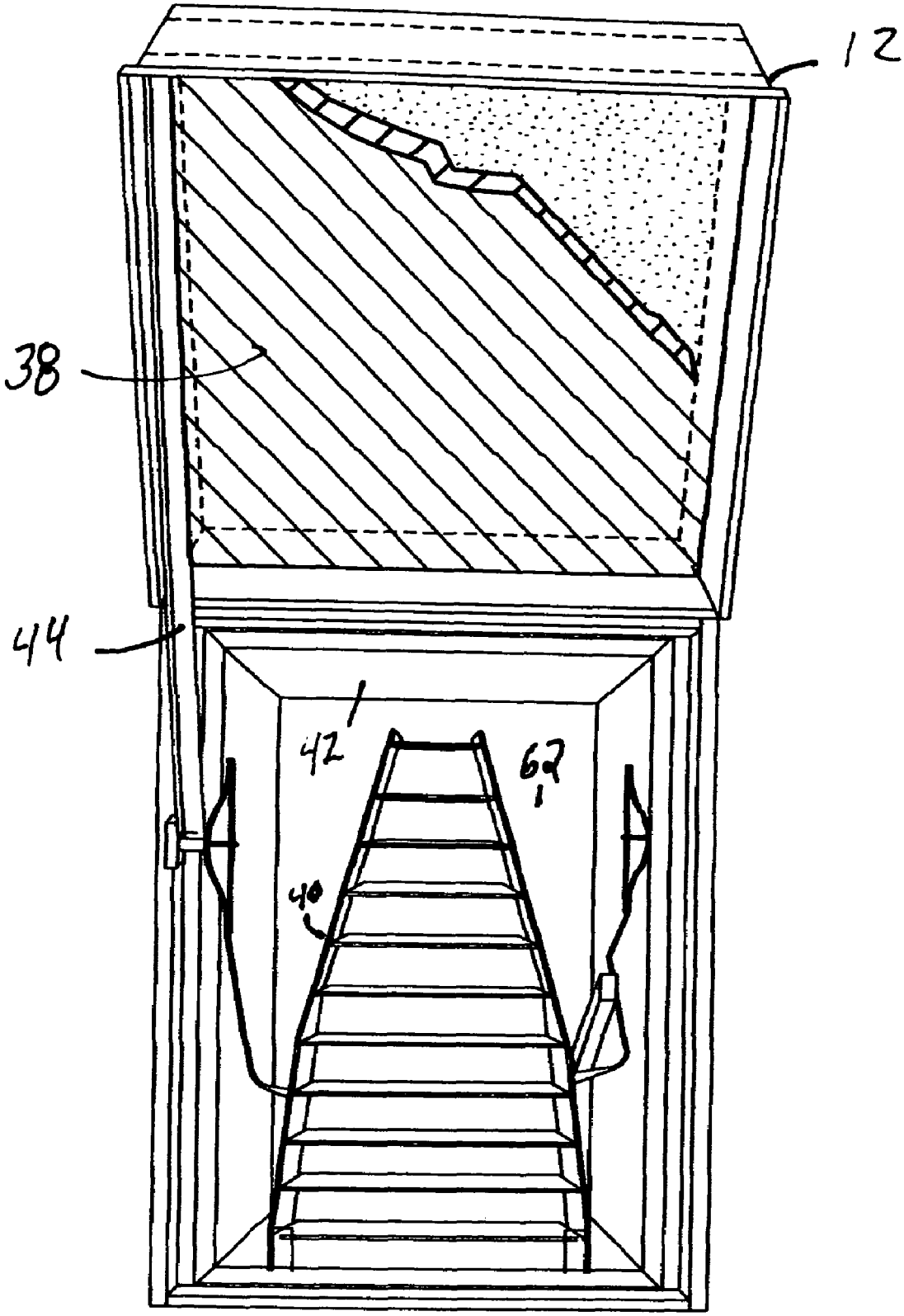
FIG. 4 is a further view of the embodiment of FIG. 3 and the framed ceiling opening, with the folding stair extended to the floor level below.
Figure 6:
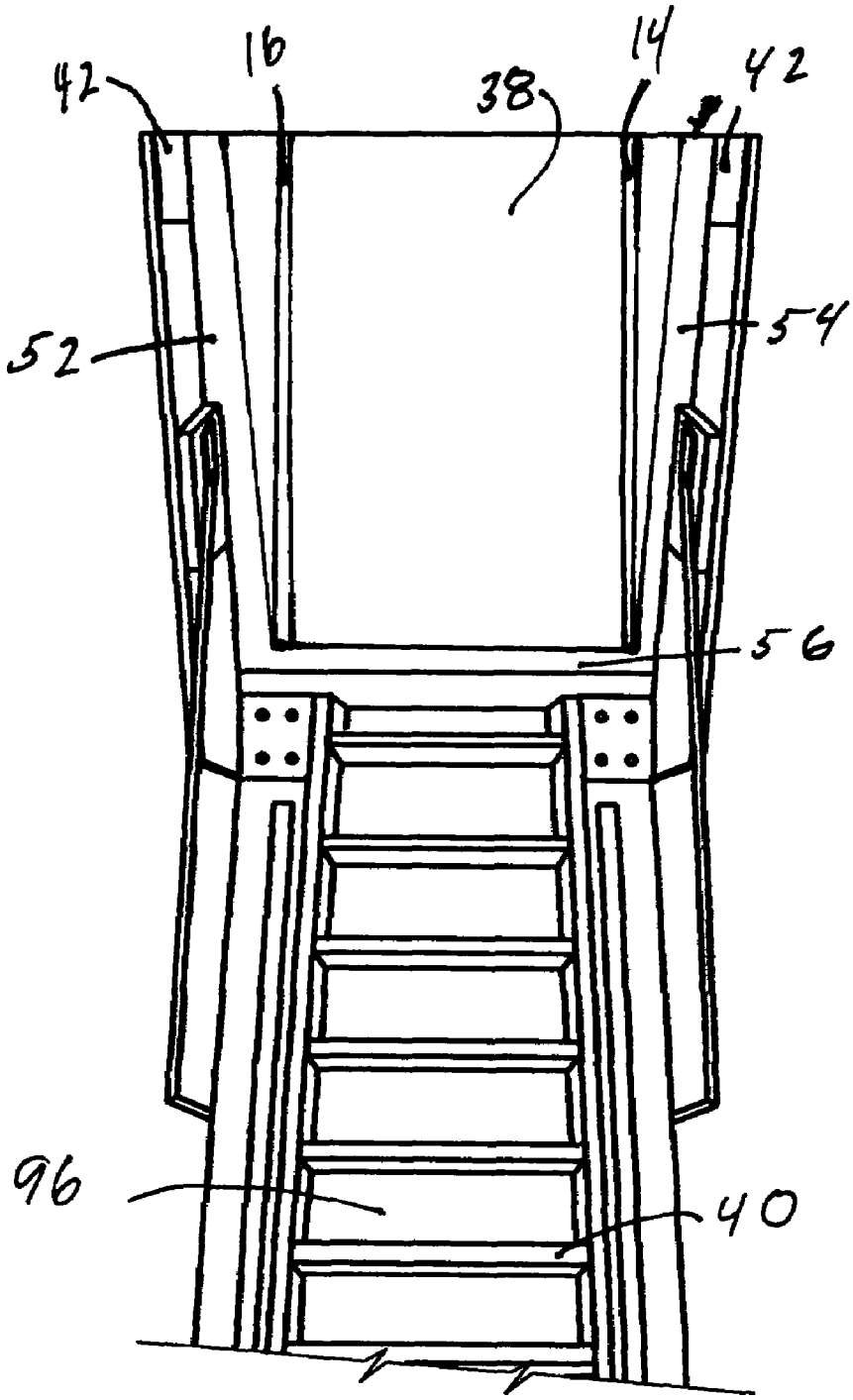
FIG. 6 is a further view of the of the embodiment of FIG. 5 with the cover assembly of the unit in the closed position, as viewed from the floor level below.
Figure 7:
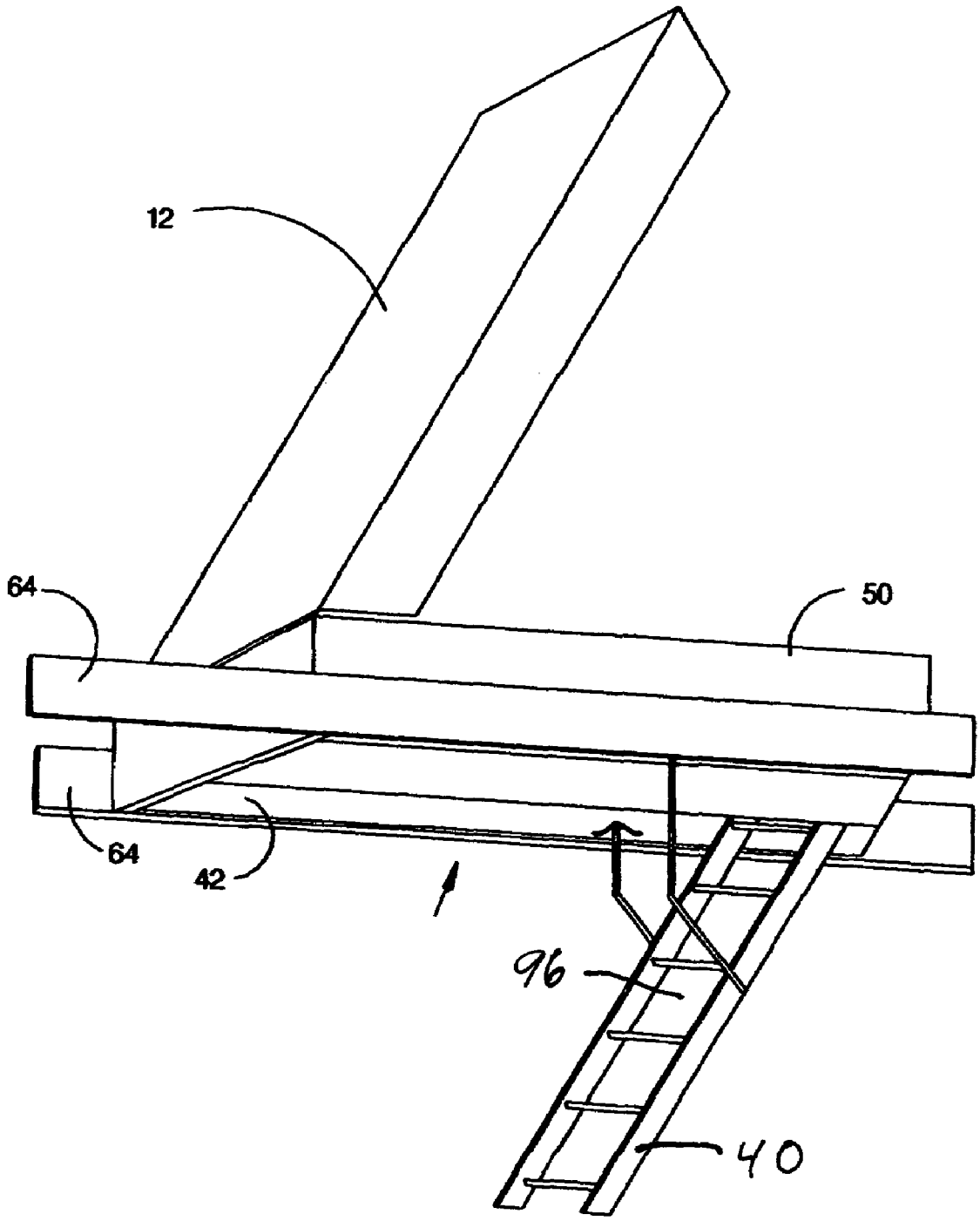
FIG. 7 is a diagram showing the placement of the folding stair unit between the ceiling framing joists with the stair extended to the floor level below, and the location of an embodiment of the present invention thereon with the cover assembly elevated.

The drawings show and illustrate an insulating enclosure for a folding stair, or other attic opening, constructed in accord with the principles of the present invention. In FIG. 1A the insulating cover 10 is shown with the insulated cover assembly 12 in an elevated position comprising cover side members 14 and 16, cover end members 18 and 20, and a cover top 22. The cover side members 14 and 16 and cover end members 18 and 20 are preferably identical in dimension and may be made of a wood product, or synthetic sheet goods such as fiberglass or plastics. The cover top 22 may similarly be made of a substantially rigid synthetic material, or a wood material such as plywood, OSB or hardboard. The insulated cover assembly 12 is constructed by side members 14 and 16 and cover top 22 joined together by the two cover end members 18 and 20. On the underside of the cover top 22 is preferably fitted thermal insulation 38 of the flat sheet foam or fiberglass batting varieties. The foam insulation may be further provided with a foil-type face to reflect heat or cold. R factors of 22 and above are possible with the present invention. The embodiment of FIGS. 3, 4 and 6 shows the foil face of the insulation, foam or batting, oriented toward the living space when the cover assembly 12 is in the closed position to aid in reflecting heat or cold back toward the living space, thus reducing loss. The embodiment in FIGS. 1B, 1C, 3, 4 and 6 show two inch foil backed foam insulation as the insulation 38 to further increase the R-value by using thicker insulation. In addition, insulation may be fitted against the inside of the end and side members to increase the insulative capacity of the cover assembly 12. Further increase in R values may be gained by adding insulation to the exterior of the unit.

Figure 8:
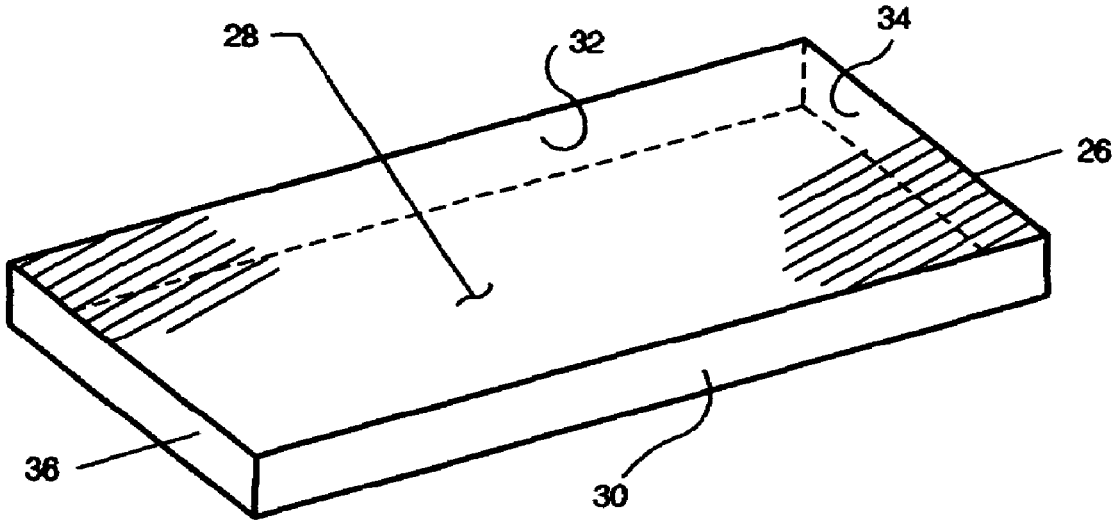
FIG. 8 is a perspective view of an embodiment of a protective member formed of sheet metal for the cover assembly of the present invention.
Figure 9:
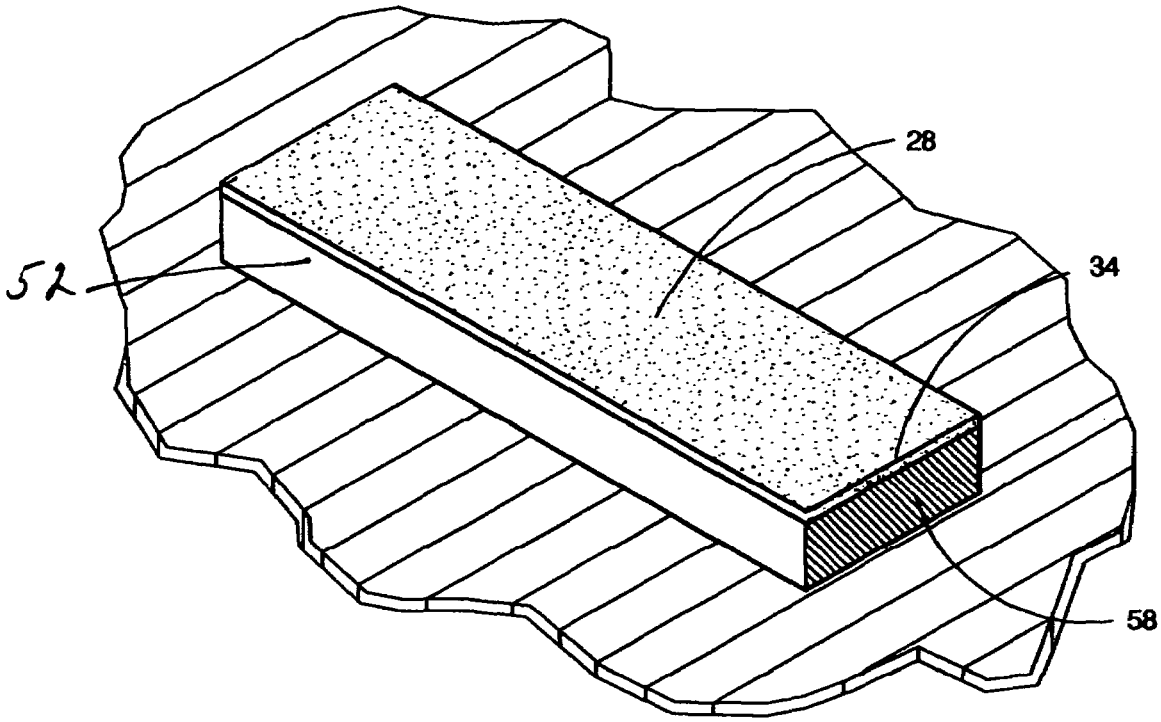
FIG. 9 is a view of the protective member of FIG. 8 installed on the cover assembly of an embodiment of the present invention.

The cover top 22 may additionally be covered by a protective member 26 as shown more fully in FIGS. 8 and 9. In FIG. 8 the embodiment of the protective member 26 has top portion 28, side portions 30 and 32, and end portions 34 and 36. The protective member 26 of FIG. 9 is made of sheet metal goods of 29 gauge, but may similarly be made of any suitable substantially rigid material, such as plastics, fiberglass, other synthetic or wood fiber material. The protective member 26 may be useful in those situations where greater strength is desired on the cover top 22 because of activity in the attic space that may damage the insulated cover assembly 12, to provide greater strength of the cover 22 to enhance safety of working in the attic, or if is exposed to weather. In addition, it may be desirable to use a protective member 26 to protect or cover any insulation added to the exterior of the unit 10. If the protective member 26 is exposed to weather it may be made of material that is weather resistant based upon the prevailing conditions, such as metal or synthetic materials, or flexible materials that are synthetic rubber-like, plastic-like, or fiberglass. In many attic installations, damage or weather exposure is not an issue so the protective member 26 is not required. Thus to save weight and expense, the protective member 26 is omitted and the cover top 22 may be made of hardboard as a suitable compromise between weight, durability and expense. In addition, if the cover side members 14 and 16, and the cover end members 18 and 20 are made of wood material, they may be decorated or painted. A hardboard cover top 22 may be similarly decorated or painted.

Figure 2:
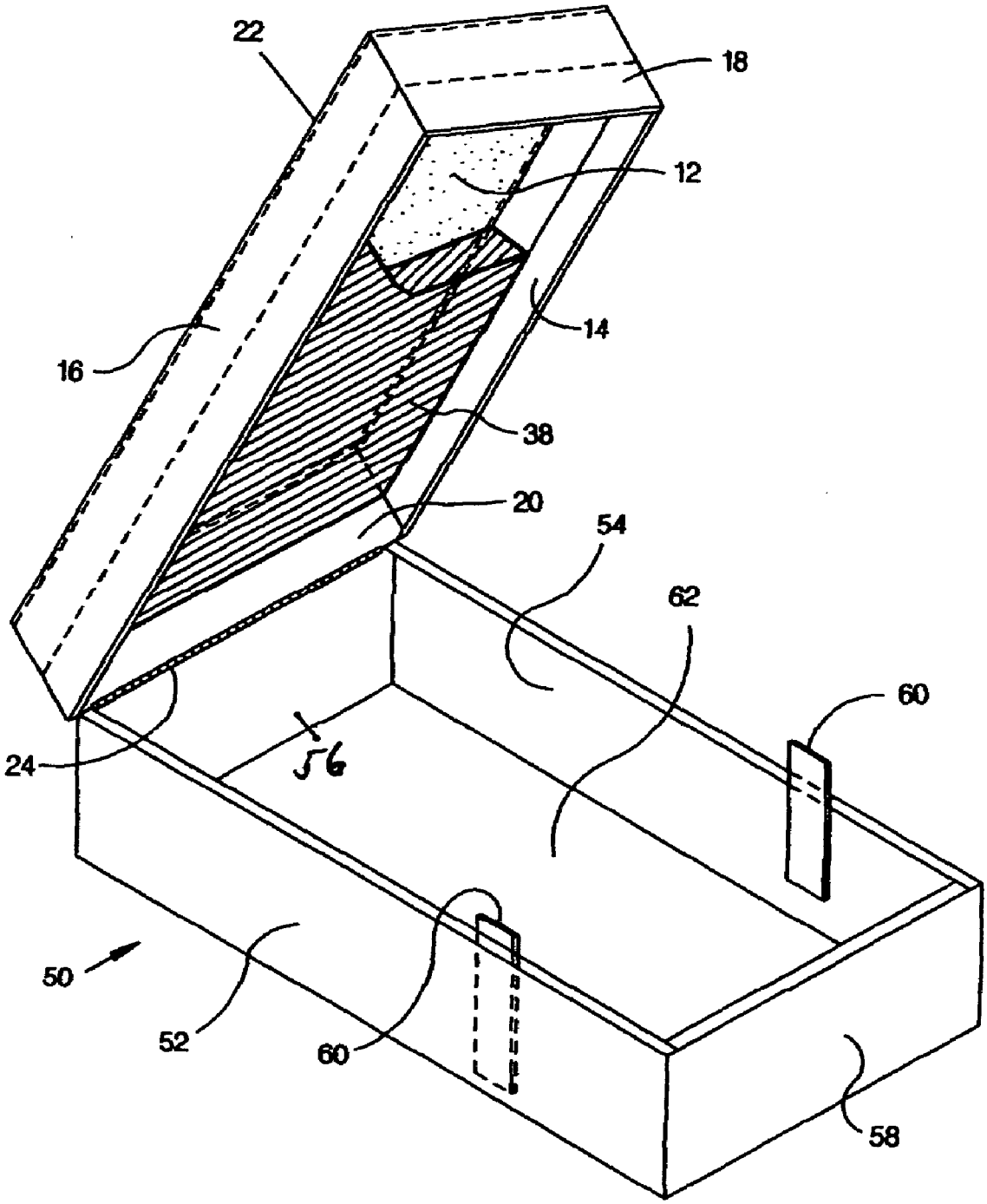
FIG. 2 is a perspective view of the embodiment of FIG. 1 showing the configuration of the unit with the cover assembly in an elevated position.

In FIG. 2, the insulated cover assembly 12 rests upon a cover support frame 50. The cover support frame 50 comprises frame side members 52 and 54, and frame end members 56 and 58 in dimension and construction substantially similar to the insulated cover assembly 12, such that upon closure the cover assembly 12 rests directly on the frame 50. Alignment of the cover assembly 12 to the frame 50 may be aided by one or more cover guides 60.

To increase the insulative capacity of the insulating enclosure 10, the inside and outside surfaces of the frame members 52, 54, 56 and 58 may be similarly insulated as above for the cover members 14, 16, 18 and 20. To further improve the insulative capacity of the invention, weather stripping may be employed at the joint where the lower edges of the cover side members 14 and 16, and the cover end members 18 and 20 interface with upper edges of their respective counterparts of the support frame 50, the frame side members 52 and 54, and the frame end members 56 and 58.

The insulated cover assembly 12 in FIG. 2 is shown in elevated position to allow access up and down the extended stairs. To be elevated, the cover assembly 12 is either pushed up from below as someone ascends the stairs, or lifted from above, and rotates on a hinge 24, or the like, attached at corresponding end members or side members. The hinge or hinges may be one or a plurality of the standard butt-type hinge, or a continuous hinge known as a piano hinge, or other configuration, to allow rotation and pivoting of the cover as described. The hinge 24 also acts to keep the insulated cover assembly 12 substantially aligned with the cover support frame 50.

Figure 5:
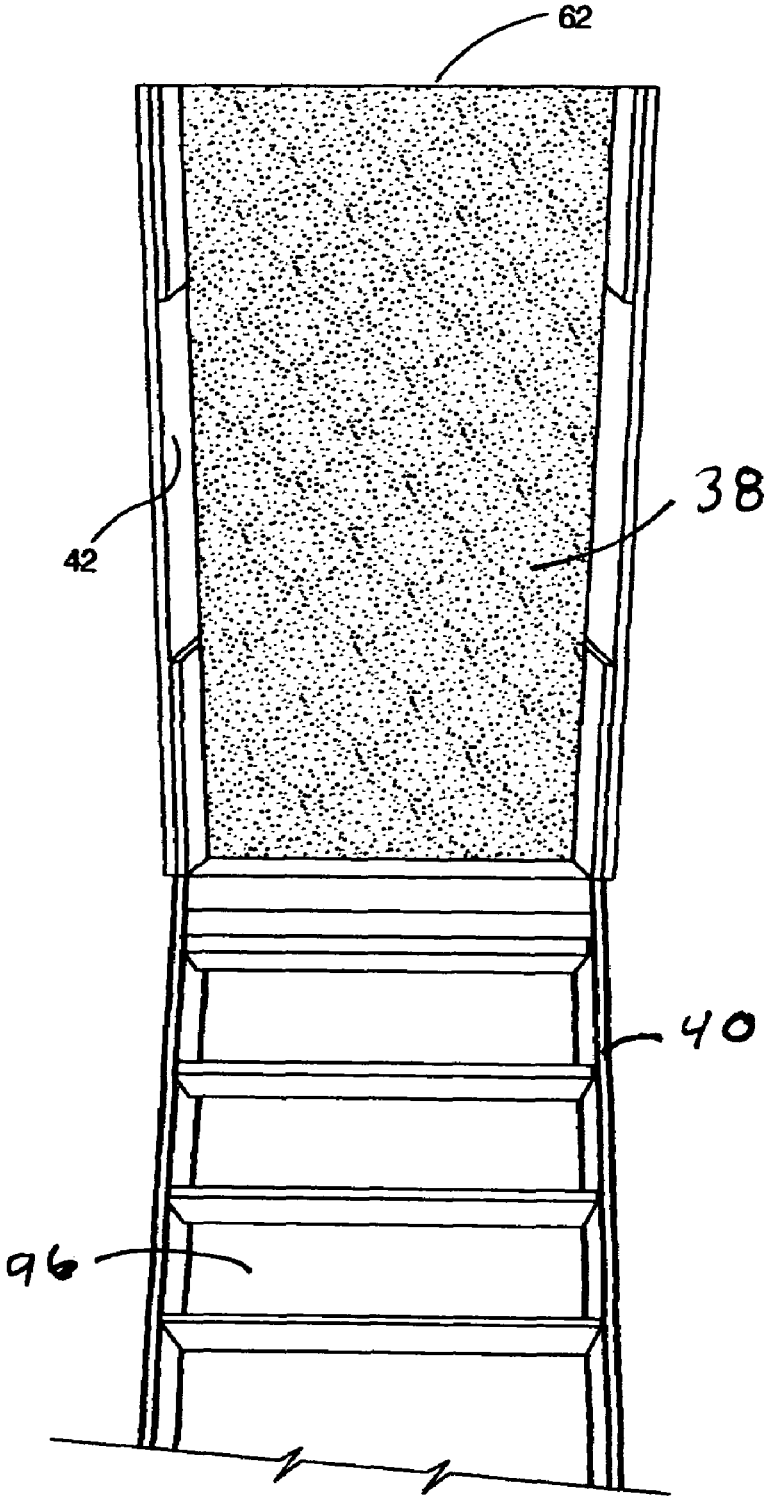
FIG. 5 is a further view of the embodiment of FIG. 3 from the lower floor level with the stair extended showing the framed opening in the ceiling.

In FIGS. 4 and 5 the stairs 40 are shown in the extended position with the insulation cover assembly 12 in the elevated position. To maintain the elevated position of the cover assembly 12, the embodiment of FIGS. 3 and 4 provide a support 44 of a configuration and construction of simplicity and minimal expense of wood, having a first end 46 and a second end 48. The second end 48 is configured to straddle or otherwise attach to frame side member 52, while the first end 46 is placed inside cover side member 16 and against the undersurface of the cover top 22. The length of the support 44 may be varied according to the needs and preferences of the installation.

Figure 10:
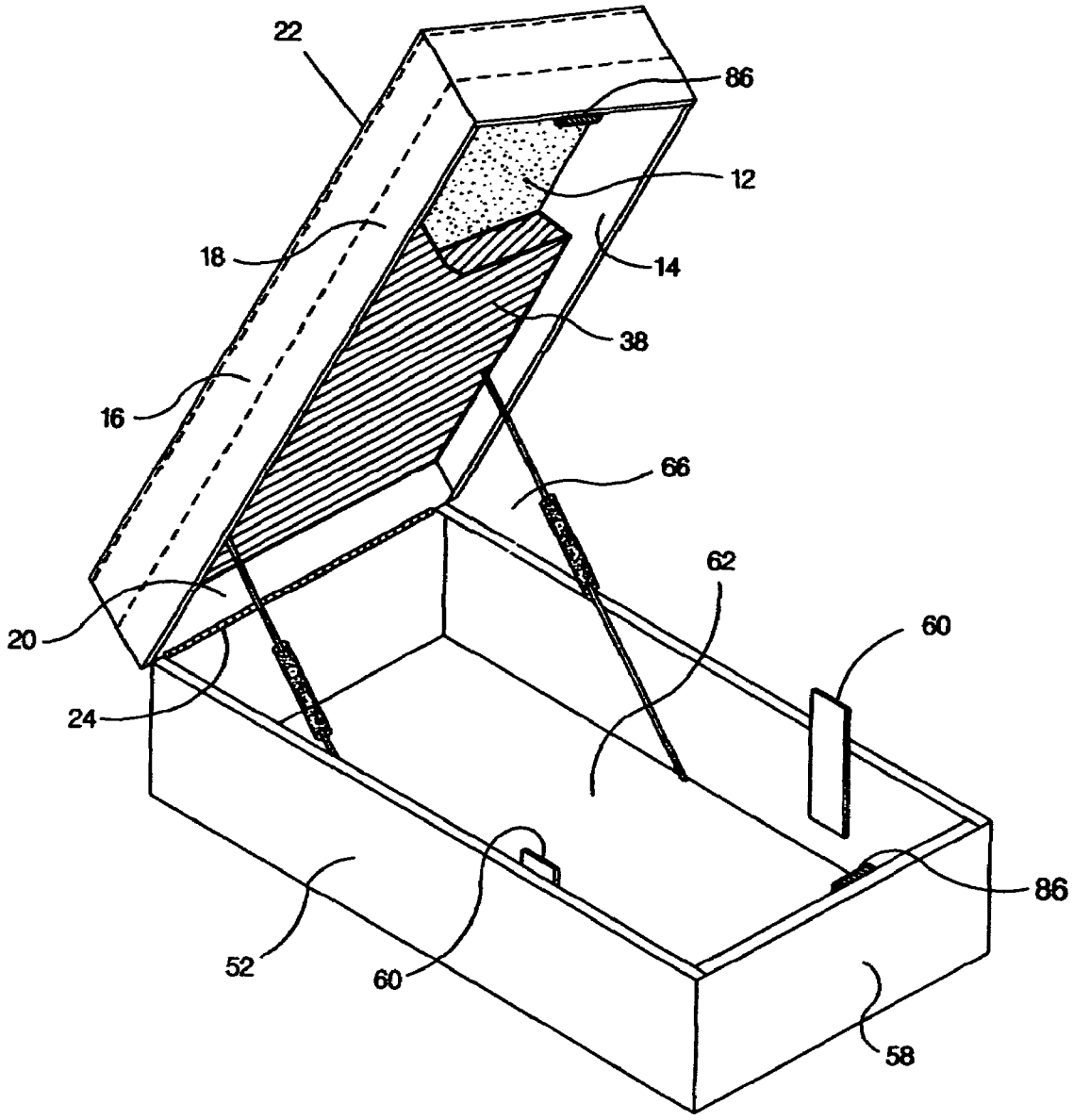
FIGS. 10, 11 and 12 are perspective views of an embodiment showing various types of supports for the cover assembly.
Figure 11:
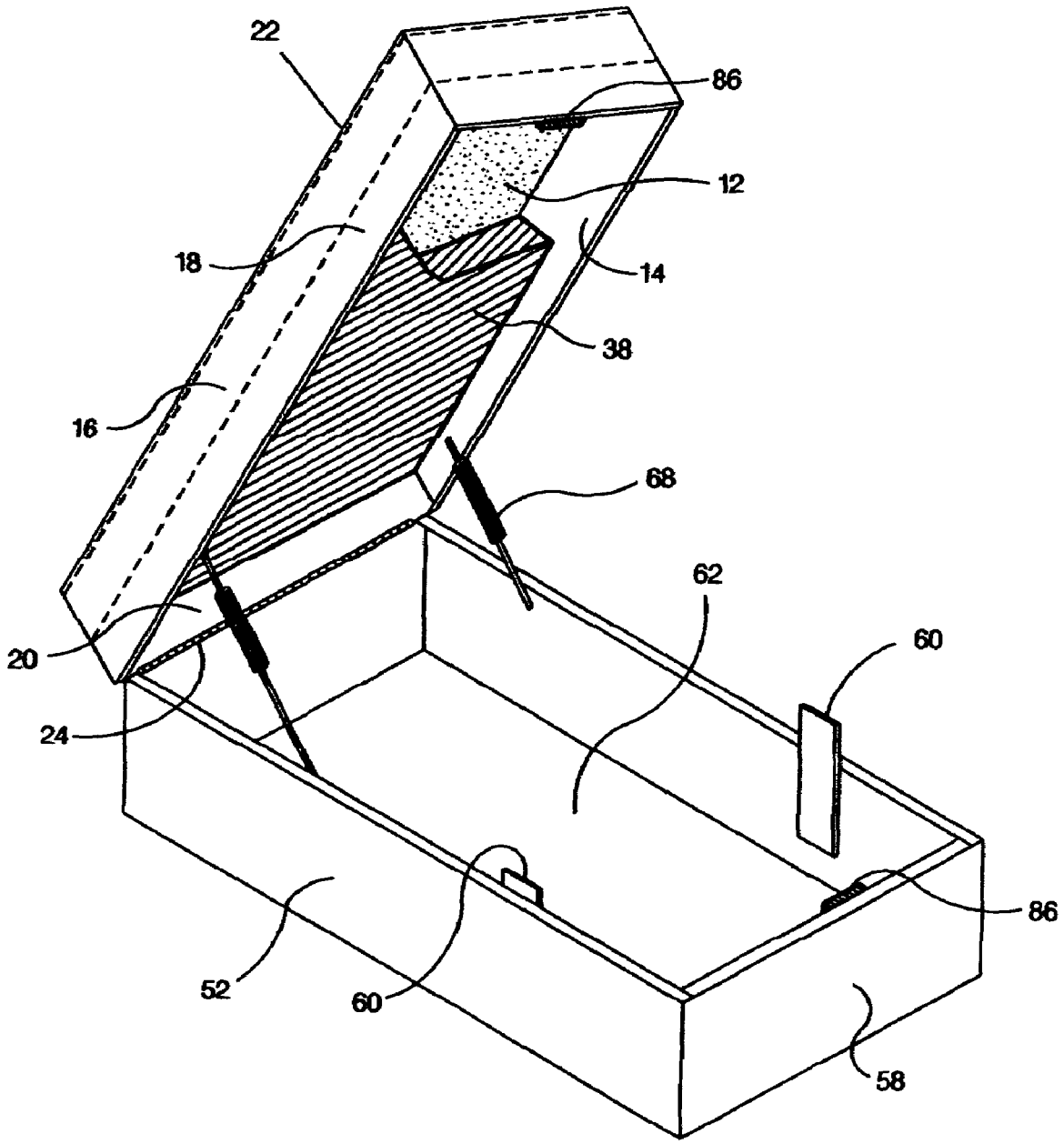

In the further embodiments of FIGS. 10 and 11, one or more types of supports 44 may be employed to elevate the cover assembly 12, such as an air or liquid hydraulically assisted cylinder 66, or a spring assisted apparatus 68 configured in tension or compression mode. For example, a pair of hydraulically assisted cylinders 66 located near the hinge 24 and attached below on the inside of the frame side members 52 and 54, and above on the inside of the cover side members 14 and 16 would expand as the cover assembly 12 opens, and then compress when the cover assembly 12 was moved toward the closed position. Similarly, a pair of spring assisted supports 68, such as individual springs or spring-assisted hinges 24, could be employed in substantially the same manner.

Figure 12:
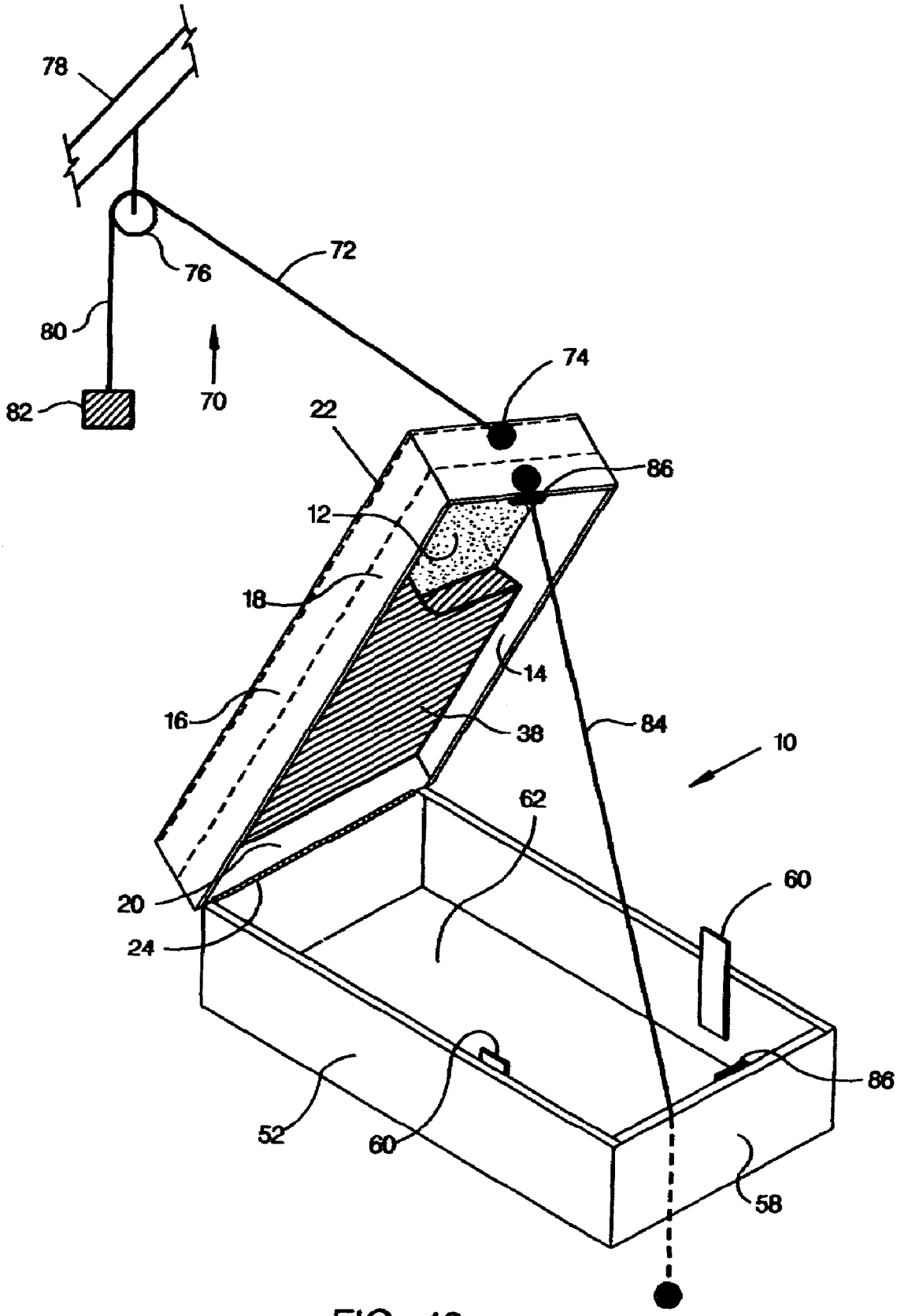

In the further embodiment of FIG. 12, a pulley and counterweight apparatus 70 could be attached to the cover assembly 12 to raise and lower in a like manner to the supports 66 and 68 previously described. In one configuration, a cord or chain-like connector 72 is preferably attached at 74 to the end or side opposite the hinged side of the cover assembly 12, the connector 72 is then traversed to a pulley 76 attached above the cover, such as to a roof rafter 78, and the second end of the connector 80 is then attached to a weight 82 of substantially similar weight to that of the cover assembly 12. As the cover assembly 12 is opened the weight 82 descends to counter the weight of the cover assembly 12.

To close the cover assembly 12 as the operator descends the stairs, the support 44 is removed and laid aside and the cover assembly 12 closed as the operator descends the stairs 40. If hydraulic assisted 66, spring assisted 68, or counter-weight based supports 70 are fitted to the unit 10, a simple cord 84 could be attached inside the end member 18 to urge the cover assembly 12 to the closed position.

When the cover is in the closed position, a latching mechanism 86 may be engaged to retain the cover assembly 12 closed. The latching mechanism 86 may be manually or automatically engaged. When the latch 86 is released, the hydraulic assisted 66, spring assisted 68 or counter-weight supports 70 would aid the elevation of the cover assembly 12. The opening of the cover assembly 12 could occur automatically with the release of the latch 86, or require some assistance from the user. Thus the cover assembly 12 may be easily opened and closed on each trip up and down the stair 40. The cover assembly 12 would not have to be left open during repeated trips and thus would prevent the large amount of heat transfer with the living space. If a cord 84 is used as above, it may have a sufficient length to extend down into the living space thus allowing someone not on the stairs to open or close the cover assembly 12 from below.

In FIGS. 3 to 7, commercially available folding attic stairways typically are provided with the stairway apparatus 40 secured within a mounting wood frame 42. The ceiling support boards, or joists 64, are configured to provide an opening just large enough for the outside dimension of the frame 42 to fit within. The stair frame 42 is located in position and attached with strong fasteners so that the ceiling joists support the weight of the stairs 40 and anyone using them. Once the stair frame 42 is secured, the cover support frame 50 of the present invention is aligned and attached to the stair frame 42 preferably with fasteners to substantially secure the support frame 50 to the stair frame 42. Preferably, the stair frame 42 has substantially the same internal dimension as the support frame 50 thereby providing a substantially smooth transition from the one frame to the other. A close fit around the junction of the two frames is preferable to reduce or eliminate temperature movement at the joint. Weather stripping, tape or caulking may be included in the joint at time of installation, or at any time thereafter to reduce air transfer.

If a stair assembly is not located in the opening, such as a scuttle hole or hatchway, preferably the framing joists 64 are dimensioned as above to be substantially the same to allow easy access and proper mating of the lower edge of the frame 50. However, an advantage of the present invention is that the members may be cut to fit existing dimensions as needed. Once the frame 50 is installed, the cover assembly 12 is attached, the support(s) attached if any, interior or exterior insulation attached, and any protective covering completed.

It should be noted that the configuration of the insulated enclosure 10 is such that no attic flooring is required for the unit's installation or operation. It may be provided to the installation site dimensioned to fit directly on top of any framed opening 62, or its components quickly modified to attach to available dimensions. In addition, the unit parts may be manufactured to certain dimensions substantially similar to the largest dimension of commonly installed stair units or attic openings. The individual pieces may then be cut by the installer and/or provided with pre-measured cutting lines to allow for configuration into a smaller unit by the installer modifying the dimensions to fit the opening encountered. This option increases the variability of the product and convenience to the consumer, especially if exact dimensions are not known at the time of purchase. In addition, fewer manufactured pieces reduce cost of manufacture, further reducing the price to the consumer.

Figure 13:
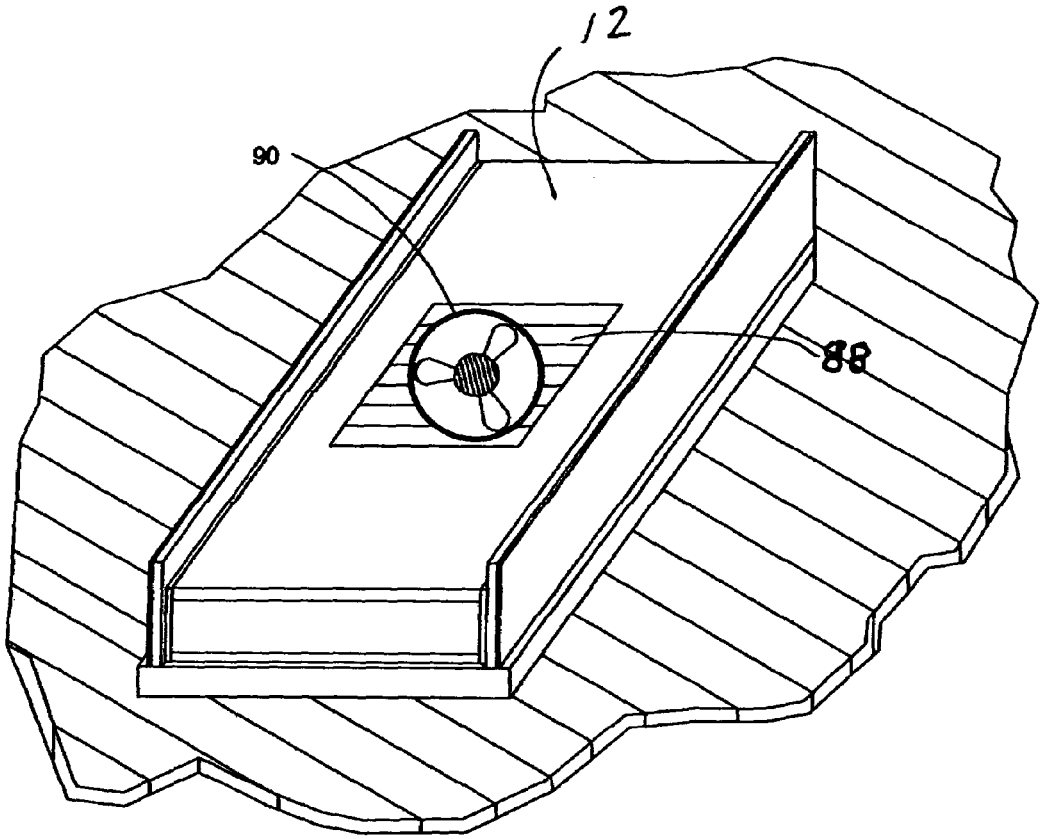
FIG. 13 is an attic view of an embodiment of the insulated cover showing the placement of a ventilation fan and louver assembly in the cover assembly.
Figure 14:
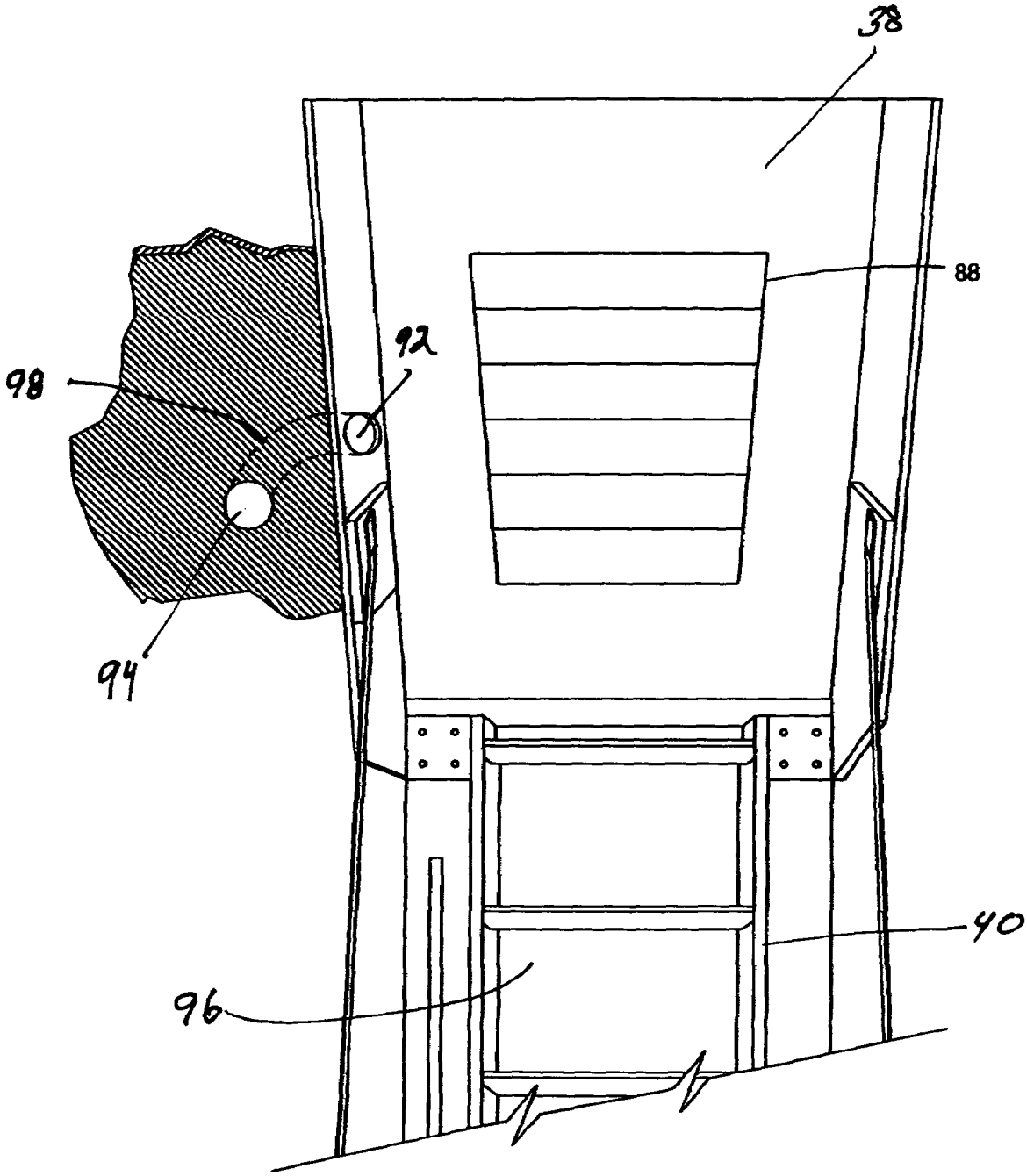
FIG. 14 is a view of an embodiment of the insulated cover below the ceiling opening with the stair extended showing the placement of a ventilation louver assembly in the insulated cover assembly and vents from the stair space to the ceiling.

In the further embodiments of FIGS. 13 and 14, the cover top 22 may be fitted with passive or powered ventilation. Passive ventilation could include manually operated or automatic louvers 88 as are commercially available for attic ventilation. Commercially available powered ventilation usually uses an electric motor and fan assembly 90. Such an assembly is commonly mounted on a roof or attic vent and automatically controlled by a thermostat or timer to draw hot air out of a confined space, such as an attic. Another means of venting attic air is by using a ceiling mounted exhaust fan incorporating a louvered cover. When the fan is powered on, the louvered cover opens to draw air from the living space into the attic and out an attic vent. The louver closes when the fan is turned off to prevent temperature gain or loss from the attic.

For example, an embodiment of the present invention would have a powered ventilation fan and louver assembly 90 fitted in the cover top 22. The controls could be mounted in the living space. The increase in weight in the cover assembly 12 would require that any supports 44, 66, 68 or 70 be adjusted to support the additional weight of the ventilation assembly 90. Passive louvers 88 or a powered fan 90 would only be effective to draw air into the attic if the stairs 40 were opened. While effective, the extended stairs could be an annoyance intruding into the living space. Thus the stair cover 96 may be modified or retrofitted with a louver-type assembly 88 to allow such ventilation as needed. Similarly, if the stair 40 were to remain closed, vents 92 could be provided laterally through the stair frame 42 and joists 64 and open in the ceiling 94 to draw air from the living space into the opening 62 occupied by the folded stair 40, through the fan 90 and out an attic roof or wall vent. With the use of flexible ducting 98, these ceiling vents 94 could be placed in a plurality of locations. Similarly, if no stair unit 40 is present, the ceiling stair cover 96 may be modified as above to allow air flow and the side vents 92 and 94 may not be necessary. In some cases, just opening the stair cover 96 an inch or so may be sufficient to allow ventilation through the mechanism included in the insulated cover assembly 12.

Since expense of purchasing an insulating cover 10 and expense of shipping are frequently the major issues, the components of the insulating enclosure 10 may be shipped unassembled in substantially flat containers, such as one or more cardboard-type boxes. Upon arrival, the unit 10 pieces may then be assembled with fasteners, which may include metal, synthetic, or adhesive-type materials, and installed onsite in a fairly rapid manner. The present invention may be used in new construction, or retrofitted to an existing stair or hatchway installation.

It is understood that the embodiments and descriptions of the invention herein described are merely instruments of the application of the invention and those skilled in the art should realize that changes may be made without departure from the essential elements and contributions to the art made by the teachings of the invention herein.

NUMBERS ON FIGURES-TAYLOR INSULATING COVER

10. insulating enclosure
12. insulated cover
14. cover side member
16. cover side member
18. cover end member
20. cover end member
22. cover top
24. hinge
26. protective member
28. 22 top portion
30. 22 side portion
32. 22side portion
34. 22 end portion
36. 22 end portion
38. insulation
40. stairs
42. stairs mounting wood frame
44. support
46. 38 first end
48. 38 second end
50. cover support frame
52. frame side member
54. frame side member
56. frame end member
58. frame end member
60. cover guide
62. stair opening
64. joists
66. hydraulic assist cylinder support
68. spring assist cylinder support
70. counterweight apparatus
72. connector
74. connector first end attachment
76. pulley
78. rafter
80. connector second end
82. weight
84. cord
86. retaining mechanism
88. ventilation louver assembly
90. powered ventilation
92. frame vent
94. ceiling vent
96. stair cover
98. flexible ducting

What is claimed is:

1. An insulating cover for a folding stair assembly comprising:

a. a support frame with inner perimeter dimensions corresponding to the inner perimeter dimensions of the stair frame and outer perimeter dimensions corresponding to the outer perimeter dimensions of the stair frame, said support frame comprising a first end element, a second end element, a first side element, a second side element, b. a cover assembly having corresponding inner and outer dimensions of said support frame comprising a first end element, a second end element, a first side element, a second side element, a top element comprising an outer layer and an inner insulating layer, and a ventilation apparatus disposed in the top element to allow air flow through said cover, c. a hinge apparatus connected to the end element of said support frame and to the corresponding end element of said cover assembly, said cover assembly movable between a first closed position in alignment and in contact with said frame, and a second open position to provide through access, d. an air transfer barrier interposed between said stair frame and said support frame, and e. said support frame substantially aligned and securedly attached to said stair frame.

2. The insulating cover of claim 1 wherein said hinge apparatus is connected to the side element of said support frame and secondly to the corresponding side element of said cover assembly, said cover assembly movable between a first closed position in alignment and in contact with said frame, and a second open position to provide through access.

3. The insulating cover of claim 1 wherein the support frame first end element, second end element, first side element and second side element comprise an outer protective layer and an inner insulating layer.

4. The insulating cover of claim 1 wherein the cover assembly first end element, second end element, first side element and second side element comprise an outer protective layer and an inner insulating layer.

5. The insulating cover of claim 1 wherein the frame elements and the cover assembly elements comprise a wood fiber material.

6. The insulating cover of claim 1 wherein the insulation comprises fiberglass batting.

7. The insulating cover of claim 1 wherein the insulation comprises foam insulation.

8. The insulating cover of claim 1 wherein the insulation comprises foam insulation comprising an attached foil layer.

9. The hinge apparatus of claim 1 wherein said hinge apparatus comprises one or more butt-style hinges.

10. The hinge apparatus of claim 1 wherein said hinge apparatus comprises a piano hinge.

11. The insulating cover of claim 1 wherein a cover assembly support apparatus is operative to enable the second open position of said cover assembly.

12. The cover assembly support apparatus of claim 11 comprising a center length portion, a first end and a second end, said cover assembly support apparatus first end positioned to engage the underside of the cover assembly top element and the second end positioned to engage said support frame, said apparatus operative to enable the second open position of said cover assembly.

13. The cover assembly support apparatus of claim 11 wherein said cover assembly support apparatus is hydraulically assisted.

14. The cover assembly support apparatus of claim 11 wherein said cover assembly support apparatus is spring assisted.

15. An insulating cover for a folding stair assembly comprising:

a. a support frame with dimensions that may be modified to correspond to a plurality of dimensions of a stair frame, comprising a first end element marked for cutting at a plurality of predetermined lengths, a second end element marked for cutting at a plurality of predetermined lengths, a first side element marked for cutting at a plurality of predetermined lengths, and a second side element marked for cutting at a plurality of predetermined lengths, b. a cover assembly having corresponding dimensions modifiable to correspond to a plurality of dimensions of said support frame, comprising a first end element marked for cutting at a plurality of predetermined lengths, a second end element marked for cutting at a plurality of predetermined lengths, a first side element marked for cutting at a plurality of predetermined lengths, a second side element marked for cutting at a plurality of predetermined lengths, a top element comprising an outer protective layer and an inner insulating layer marked for cutting at a plurality of predetermined lengths and widths, and a ventilation apparatus disposed in the top element to allow air flow through said cover assembly, and c. a hinge apparatus connected to the end element of said support frame and to the corresponding end element of said cover assembly, said cover assembly movable between a first closed position in alignment and in contact with said support frame, and a second open position to provide through access.

16. The insulating cover of claim 15 wherein the support frame elements and the cover assembly elements comprise an outer protective layer and an inner insulating layer.

17. The insulating cover of claim 15 wherein the inner insulating layer is fiberglass.

18. The insulating cover of claim 15 wherein the inner insulating layer is foam insulation.

19. The insulating cover of claim 15 wherein the inner insulating layer is foam insulation with a foil layer attached thereon.

20. The hinge apparatus of claim 15 wherein said hinge comprises one or more butt-style hinges.

21. The hinge apparatus of claim 15 wherein said hinge comprises a piano hinge.

22. The insulating cover of claim 15 wherein a cover assembly support apparatus is operative to enable the second open position of said cover assembly.

23. The cover assembly support apparatus of claim 22 wherein said cover assembly support apparatus comprises a center length portion, a first end and a second end, the cover assembly support apparatus first end positioned to engage the underside of the cover assembly top element and the second end positioned to engage the said support frame, said apparatus operative to enable the second open position of said cover assembly.

24. The cover assembly support apparatus of claim 22 wherein said cover assembly support apparatus is hydraulically assisted.

25. The cover assembly support apparatus of claim 22 wherein said cover assembly support apparatus is spring assisted.

26. The insulating cover of claim 15 wherein said cover assembly comprises a protective member attached to the exterior of the end, side and top elements.

27. The cover assembly of claim 26 wherein the protective member comprises sheet metal.

* * * * *